United States Patent [19]

Hughes et al.

[11] 3,955,625

[45] May 11, 1976

[54] CEMENTING BASKET

[75] Inventors: Earnest D. Hughes; Peter W. Seitz, both of Wichita Falls, Tex.

[73] Assignee: The Dow Chemical Company, Midland, Mich.

[22] Filed: Mar. 6, 1975

[21] Appl. No.: 556,056

[52] U.S. Cl. ..... 166/202

[51] Int. Cl.[2] ..... E21B 33/134

[58] Field of Search ..... 166/202, 121

[56] References Cited

UNITED STATES PATENTS

| | | | |
|---|---|---|---|
| 2,305,282 | 12/1942 | Taylor et al. | 166/202 X |
| 2,602,514 | 7/1952 | Althouse | 166/202 |
| 2,664,952 | 1/1954 | Losey | 166/202 X |
| 3,362,478 | 1/1968 | McReynolds | 166/202 X |
| 3,766,981 | 10/1973 | Rundt | 166/202 |

*Primary Examiner*—Frank L. Abbott
*Assistant Examiner*—Richard E. Favreau
*Attorney, Agent, or Firm*—V. Dean Clausen; Merton B. Lilly

[57] ABSTRACT

Disclosed is an improved cementing basket for use in cementing the borehole of oil wells or gas wells. In some of the conventional cementing baskets metal slats are used to form the rigid part of the basket petals. The basket of this invention utilizes a wire loop, such as steel spring wire, for the rigid member of the basket petal.

1 Claim, 1 Drawing Figure

CEMENTING BASKET

BACKGROUND OF THE INVENTION

Broadly, the invention concerns an apparatus useful for cementing a borehole. More specifically, the invention is an improved cementing basket useful for oil well or gas well cementing operations.

When oil wells or gas wells are drilled the usual practice is to cement the annulus between the outside of the pipe casing and the borehole. This is done by using drilling mud to push a cement slurry down through the pipe casing and up into the borehole annulus. When the slurry hardens it provides a cement column in the borehole which has several functions. One job which the cement column does is to prevent corrosive materials in the formation from deteriorating the pipe casing. Another function of the cement column is to keep the borehole wall from sloughing or caving in.

During injection of the cement slurry there is a substantial amount of pressure build up in the borehole annulus. This pressure results from the hydrostatic head created by the slurry column. One of the undesirable effects of the high pressure is cement contamination of the formation at places in the borehole where the formation is weak or porous. The problem can be overcome by cementing the borehole annulus above the weak spot. In this operation the cement basket, which is positioned on the pipe casing, acts as a retainer to hold the wet cement at that spot during the initial set period.

There are various sizes and styles of commercially available cement baskets. A typical basket device is made up of flexible, overlapping petals which will conform to the shape of the borehole. The petals are usually fabricated of flexible materials, such as heavy duty canvas, thin metal, or rubber. A metal backing member, usually a flat spring steel stave, is fastened along one of the lengthwise edges of each petal. A free end of each stave is then welded into a ring structure at the bottom of the basket.

The bottom ring is slightly larger than the pipe casing to permit the basket to slide on the casing. Stop rings are fitted to the casing to hold the basket at a desired position. When the cement slurry rises upwardly through the annulus it pushes around the flexible petals and drops into the basket from the top.

The use of metal staves as backing strips of fabricate the basket petals presents a problem. The most immediate problem is difficulty in obtaining the metal staves, and a secondary problem is the extremely high cost. A particular advantage of the present invention is a cement basket which is easier to fabricate and which utilizes less expensive materials than the baskets described above.

SUMMARY OF THE INVENTION

The cementing basket of this invention is particularly useful for cementing the borehole of an oil well or a gas well. The basket is made of several petal members and a ring structure comprising an inner ring and an outer ring. The outer ring has a larger diameter to enable it to fit over the inner ring. Each of the petal members comprises a flat section of a flexible material.

One lengthwise edge of the flat section is referred to as a leading edge. The other lengthwise edge is referred to as a trailing edge. An elongate wire loop is secured to the leading edge of the petal. Part of the loop includes an open end which is fastened between the inner and outer rings. When the basket is in operating position in the borehole the trailing edge of each petal overlaps the leading edge of an adjacent petal, so that the petals define a circular pattern which conforms to the borehole wall.

DESCRIPTION OF A PREFERRED EMBODIMENT

Figure 1:
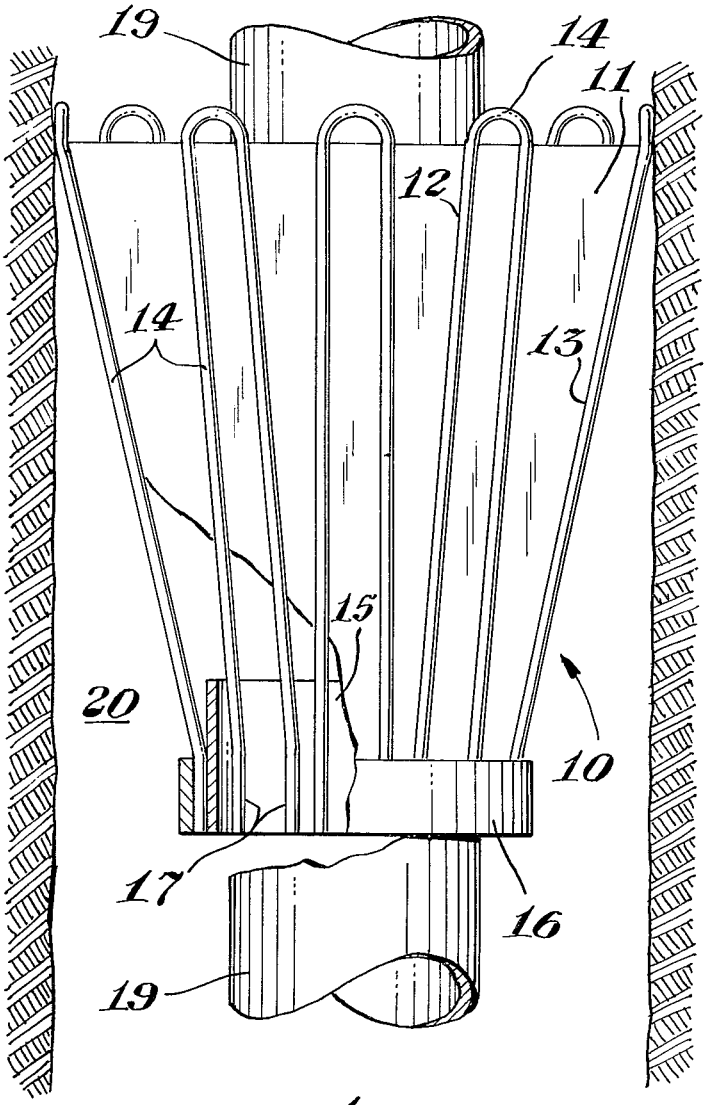
FIG. 1 is a front view, partly in section, of a cementing basket according to this invention. In this illustration the basket is shown in the usual operating position, that is, installed on a pipe casing within a borehole.

In the drawing numeral 10 refers generally to a cementing basket according to one embodiment of the invention. The basket 10 is made up of several petal members 11 and a ring structure at the bottom of the basket. Each petal member 11 is defined by a flat section of flexible material. A front lengthwise edge of the section is designated as leading edge 12. The rear lengthwise edge of the petal is referred to as a trailing edge 13.

Fastened to each petal 11 is an elongate wire loop 14. As shown in FIG. 1, the loop 14 is fastened to petal 11 such that one leg of the loop is flush with the leading edge 12, and the other leg of the loop is secured to the petal fabric behind the edge 12. The bottom ring structure of basket 10 is made up of an inner ring 15 and an outer ring 16. The outer ring 16 has a larger inside diameter so that it will fit over the inner ring 15.

Figure 2:
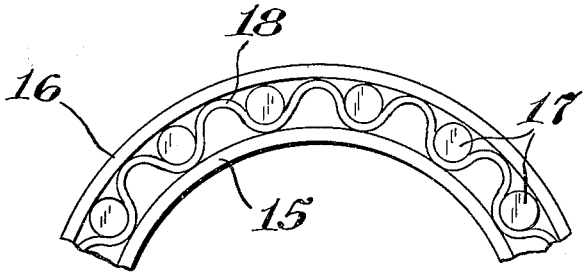
FIG. 2 is a fragmentary view, looking upward toward the bottom of the ring structure of the basket shown in FIG. 1.

At the lower end of loop 14 the legs are not joined, to provide an open end 17. In assembling the basket 10 the open end 17 of each loop 14 is fastened between the rings 15 and 16. The preferred means for fastening each of the ends 17 into the ring structure is by welding. As shown in FIG. 2 a corrugated metal piece 18 is inserted between the rings 15 and 16. The purpose of corrugation 18 is to provide a spacer for holding the legs of each loop in place during the welding step.

Referring to FIG. 1, the basket 10 is shown in its operating position. In the operating position the inner ring 15 fits over the outside of the pipe casing 19, such that the basket 10 can either slide up or down on the casing, or be held in one place. If it is desired to hold the basket 10 at a spcific point in the borehole 20, this is done by attaching stop members, usually metal rings (not shown), to the casing 19. When the basket 10 is positioned in borehole 20, the flexibility of the petal members 11 allows the leading edge 12 of each petal to overlap the trailing edge 13 of an adjacent petal. The top outer edge of the basket 10 thus conforms to the circular configuration of the borehole and defines a seal with the borehole wall.

Various details regarding fabrication of the basket 10 will now be described. The basket is made in sizes to fit conventional pipe casing. The outside diameter of the casing is usually from about 2 ⅜ inches to 20 inches. Suitable materials for the petals 11 are flexible materials, such as synthetic elastomers. A preferred elastomer is styrene-butadiene rubber. This elastomer is a conventional composition which includes carbon black, zinc oxide, stearic acid and appropriate curing catalysts. The composition should be cured to a tensile strength of about 2500 psi and a Shore hardness of about 76. Understandably, the actual composition and other properties of the elastomer may vary according to the desired job specifications for the basket.

The wire loops 14 are fabricated of conventional metal wire. Suitable wire products include hard drawn spring wire, made according to specification ASTM 227–47, or steel spring wire, SAE 1070. Typical of other wire products which may be used are spring wires made of metals such as brass, bronze or beryllium. The size of the wire may vary within wide limits. Typical wire sizes for the loop will range from about No. 2 to No. 10, U.S. Steel Wire Gauge.

To form the wire loop 14 a single strand of wire is shaped to define an oblong loop 14, which includes an open end 17. A jig or other suitable metal shaping device may be used to form the wire loop. The loop 14 is then attached to the petal 11 by vulcanizing. As described earlier, loop 14 is laid flatwise on the petal 11, so that one leg of the loop is flush with the leading edge 12. When the loop is attached to petal 11 the lower ends of the legs are left free. The lower ends make up the open end 17 which is fastened into the bottom ring structure.

The invention claimed is:

1. A basket apparatus for use in cementing a wellbore, which includes:

a series of petal members, an inner ring, and an outer ring which has a larger diameter than the inner ring and which fits over the inner ring;

each petal member comprising a flat section of a flexible elastomer material, which includes a leading edge, a trailing edge, and an elongate steel spring wire loop;

the wire loop being secured to the leading edge of each petal member, the wire loop including an open end which is fastened between the inner and outer rings, and the leading edge of each petal member being in overlapping contact with the trailing edge of an adjacent petal member, such that the arrangement of the petal members defines a generally circular pattern.

* * * * *